US006019690A

United States Patent [19]

Parr et al.

[11] Patent Number: 6,019,690

[45] **Date of Patent: *Feb. 1, 2000**

[54] PORTABLE BASKETBALL GOAL ASSEMBLY

[76] Inventors: Jason Parr, 2605 Homeplace, West Bloomfield, Mich. 48325; Jonathan P. VarnHagen, 44150 Richmond, Canton, Mich. 48187

[ * ] Notice: This patent is subject to a terminal disclaimer.

[21] Appl. No.: 08/144,818

[22] Filed: Oct. 28, 1993

Related U.S. Application Data

[63] Continuation of application No. 07/901,537, Jun. 19, 1992, Pat. No. 5,316,290.

[51] Int. Cl.[7] ..... A03B 63/08

[52] U.S. Cl. ..... 473/481; 473/479

[58] Field of Search ..... 273/1.5; D21/201; 362/61, 67

[56] References Cited

U.S. PATENT DOCUMENTS

| | | | |
|---|---|---|---|
| D. 216,684 | 3/1970 | Haubert | D21/201 X |
| 2,144,148 | 1/1939 | Gross | 273/1.5 R |
| 2,227,310 | 12/1940 | Hoppes et al. | 273/1.5 R |
| 2,340,540 | 2/1944 | Lange | 273/1.5 R |
| 3,108,803 | 10/1963 | Naideth | 273/1.5 R |
| 3,233,898 | 2/1966 | Sheets et al. | 273/1.5 R |
| 3,544,110 | 12/1970 | Dickinson | 273/1.5 R |
| 3,722,886 | 3/1973 | Sinner | 273/1.5 R |
| 4,220,981 | 9/1980 | Koether | 362/61 |
| 4,330,101 | 5/1982 | Anderson | 273/1.5 R |
| 4,526,367 | 7/1985 | Haston et al. | 273/1.5 R |
| 4,712,167 | 12/1987 | Gordin et al. | 362/67 X |
| 4,789,156 | 12/1988 | D'Annunzio | 273/1.5 R |
| 4,805,904 | 2/1989 | Nye | 273/1.5 R |
| 4,869,501 | 9/1989 | Avastasakis | 273/1.5 R |
| 4,946,163 | 8/1990 | Aakre et al. | 273/1.5 R |

*Primary Examiner*—Mark S. Graham

*Attorney, Agent, or Firm*—Carrier, Blackman & Associates, P.C.; Joseph P. Carrier; William D. Blackman

[57] ABSTRACT

A portable collapsible backboard and goal assembly for a pickup truck. The assembly has a base means mounted in the bed or back of the pickup truck, a rotatable first support member attached to the base means, a rotatable second support means attached to the first support member, and a rotatable backboard and goal means attached to the second support member. The two support members and backboard and goal means are all rotatable relative to the base means and can be collapsed into a flat, compact package in the pickup truck for storage and/or transport. A first bracing means is used to hold the first and second support members in their upright, assembled positions. A second bracing means is used to hold the backboard and goal means at the desired position for use.

10 Claims, 5 Drawing Sheets

PORTABLE BASKETBALL GOAL ASSEMBLY

This is a continuation of application Ser. No. 07/901,537 filed on Jun. 19, 1992, U.S. Pat. No. 5,316,290.

BACKGROUND OF THE INVENTION

The present invention generally relates to an improved portable, collapsible basketball backboard and goal assembly which can be elevated to various heights including regulation playing height, and alternately lowered to a storage position. In one embodiment, the invention is concerned with a basketball backboard and goal assembly which is especially adapted for mounting in the back of a pickup truck or the like for easy transportation to and from any playing surface and for compact storage in the bed of the truck when not in use.

Conventional basketball backboards are typically mounted on a fixed pole or other fixed object. These conventional basketball backboards are mounted securely in concrete or other means which prevent the movement of the basketball backboard from its originally mounted location. These permanently installed backboards are considered inappropriate for use at some locations, or are inconsistent with other uses required of some locations.

Portable basketball backboards have been previously available. Such backboards are typically mounted on wheeled frames or other devices, such that the backboard can be moved from one place to another. Although such portable backboards can indeed be moved from one location to another, they are generally large and unwieldy, and are not easily stored or transported more than short distances without considerable difficulty. Furthermore, some prior assemblies do not provide an adequate distance between the backboard and the support, possibly causing injuries.

Another significant problem with the prior basketball backboard and goal assemblies is that they do not provide for adjustments to account for an uneven playing surface, while maintaining the basketball backboard and goal assembly at the appropriate height. Furthermore, prior basketball backboard and goal assemblies do not have the ability to adjust the angle of the backboard and goal to offset a slanted or uneven playing surface.

Accordingly, the object and purpose of the present invention is to provide a portable and collapsible basketball backboard and goal assembly which is mounted in the back of a pickup truck or the like so it can be transported and erected at any location, can be adjusted to any height as well as being able to be adjusted to meet the demands of the playing surface, provides for an adequate distance between the backboard and the backboard support and which can be compactly folded for ease of both transportation and storage in the rear of the pickup truck.

SUMMARY OF THE INVENTION

The present invention, which is an improvement over known devices and systems, provides a portable collapsible basketball backboard and goal assembly which is adapted for attachment to the bed of a pickup truck allowing for easy transportation and assembly at any place. The basketball backboard and goal assembly of the present invention includes a generally flat base attached to the bed of a pickup or the like, which also allows for easy storage in the pickup truck.

Extending from the base is a first support member which is hinged at its lower end to the base. The first support member is hinged at its upper end to the bottom part of a second support member which is hinged to the rear of the backboard. This configuration allows for the positioning of the goal assembly at a variety of heights and allowing the backboard to extend outward an adequate distance from the rear of the pickup.

In its preferred upright position an adjustable bracing arm, which is attached to the first support member, extends from the first support member upwardly to an intermediary attachment point on the second support member. When in its upright position, the second support member extends outward from the first support member at a specific angle, depending on the desired height and distance between the rear of the truck and the backboard. The bracing arm provides the necessary support and stability for the backboard and assembly and is adjustable to allow positioning of the backboard and goal at a desired height and orientation.

In the preferred embodiment there are provided a pair of support arms which extend outwardly from the top of the second support means and pivotably attach to the rear of the backboard for support. The support arms are adjustable or are adapted to be positioned at various points on the second support means so that the angle of the backboard can be adjusted as desired.

These and other aspects of the present invention will become more apparent from the accompanying drawings and the following detailed description of the invention.

BEST MODE(S) FOR CARRYING OUT THE INVENTION

Figure 1:
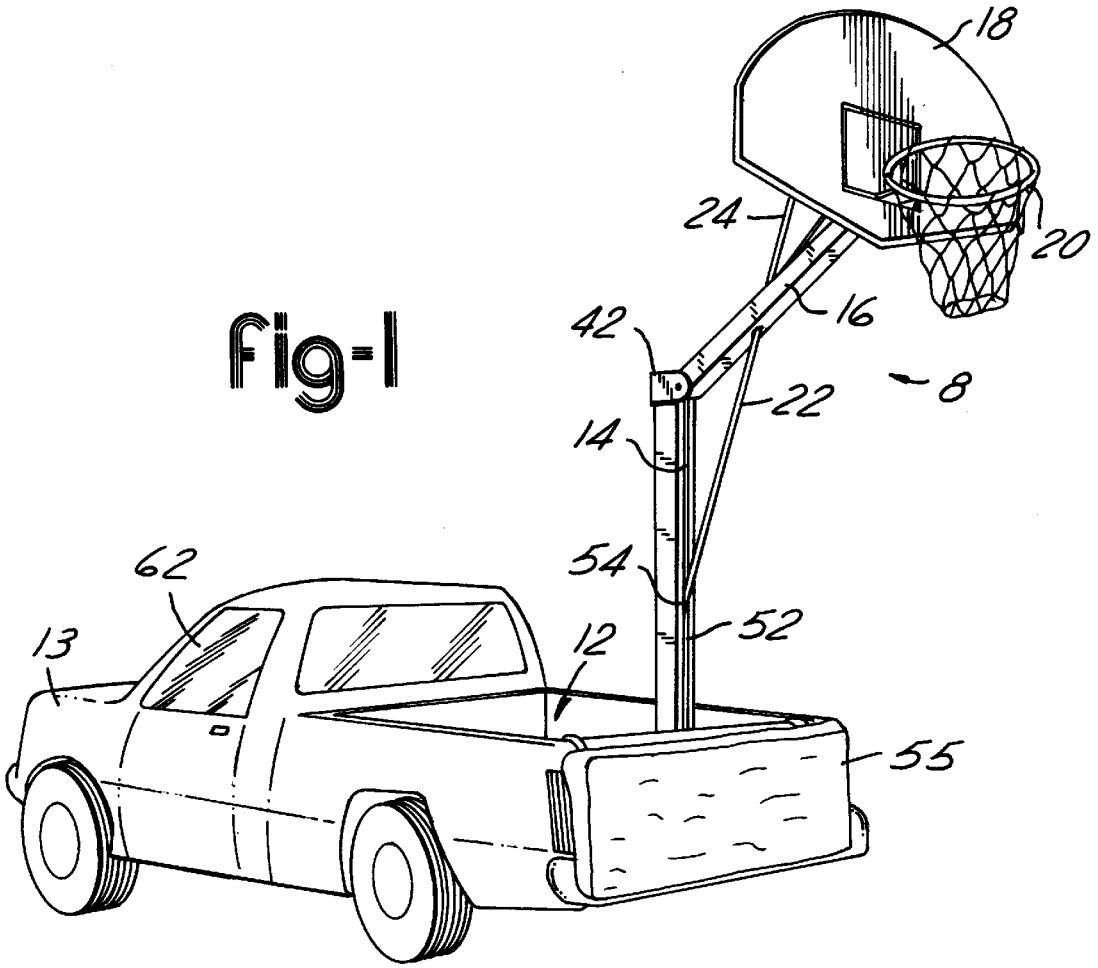
FIG. 1 is a perspective view of the preferred embodiment of the basketball goal assembly of the present invention, in the upright displayed position mounted in the back of a pickup truck.
Figure 5:
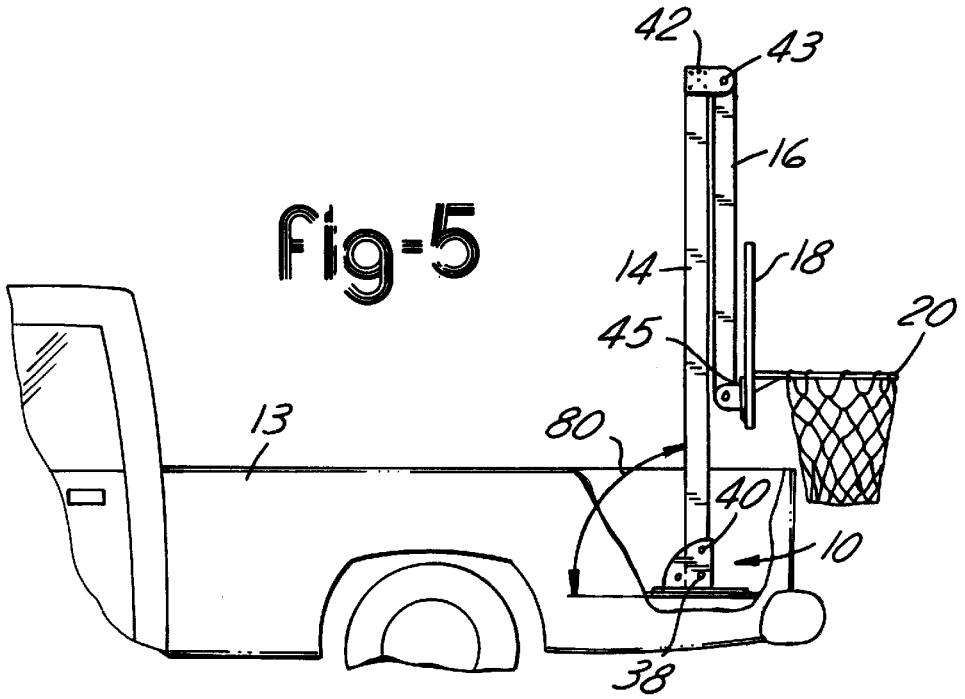
FIGS. 5 and 6 are side views of the assembly shown in FIG. 1 in intermediary positions between the fully deployed and collapsed positions in accordance with one method for deploying the assembly.
Figure 2:
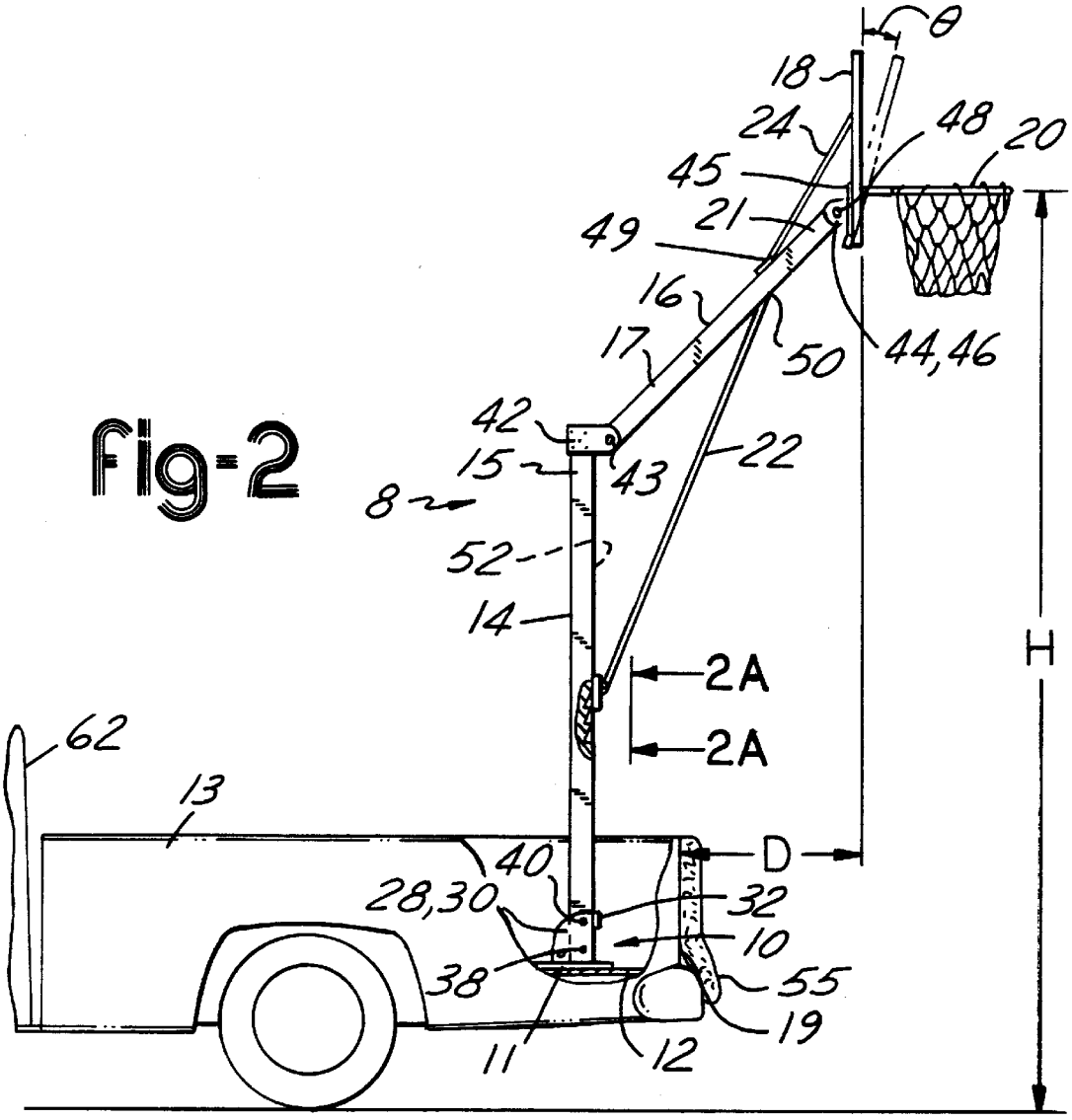
FIG. 2 is a side view of the assembly shown in FIG. 1.
Figure 2A:
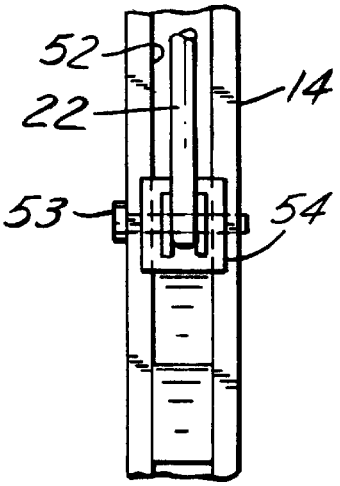
FIG. 2A is a close-up view of the area designated in FIG. 2 by the arrows 2A—2A.
Figure 6:
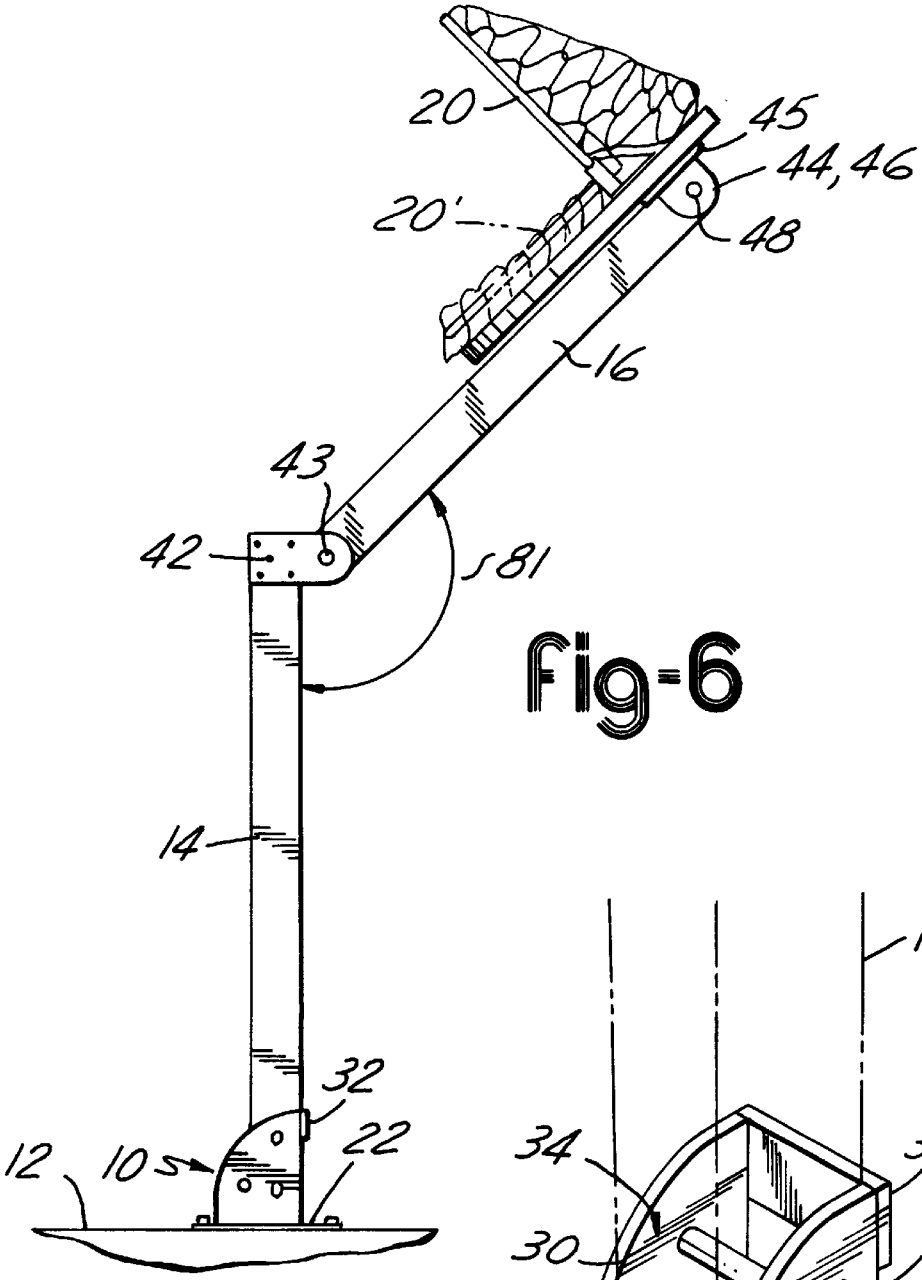

FIGS. 1–4 and 7 illustrate the preferred embodiment of the basketball backboard and goal assembly of the present invention. The assembly is shown in FIGS. 1 through 2 in an upright deployed position, and in a folded position in FIGS. 3 and 4. FIGS. 5 and 6 show the assembly at intermediate positions between the assembled and storage positions in accordance with one method for assembling the invention, as occurs either when the assembly is being raised to the upright (assembled) position or being lowered to the folded (storage) position.

In the preferred embodiment, the assembly 8 is mounted in the bed 12 of a pickup truck 13 or the like. The assembly 8 includes a base 10 which is mounted to the bed 12 of the pickup truck, a first support member 14 which is secured to the base 10, a second support member 16 which is pivotably connected to the first support member 14 and a basketball backboard 18 pivotably connected to the second support member 16 so that the goal or rim 20 fixed thereto can be adjusted accordingly. A brace arm 22 is connected to the first support member 14 and the second support member 16 to add support and stability, as well as to aid in adjusting the height "H", the distance between the playing surface and the rim 20, and the distance "D", which is measured from the rear 19 of the pickup truck to the face of the backboard. Additional support is provided by a pair of backboard support arms 24 which extend from the second support member 16 to the backboard 18 allowing for adjustment of the backboard with respect to the vertical axis, as shown by the angle θ in FIG. 2.

Figure 7:
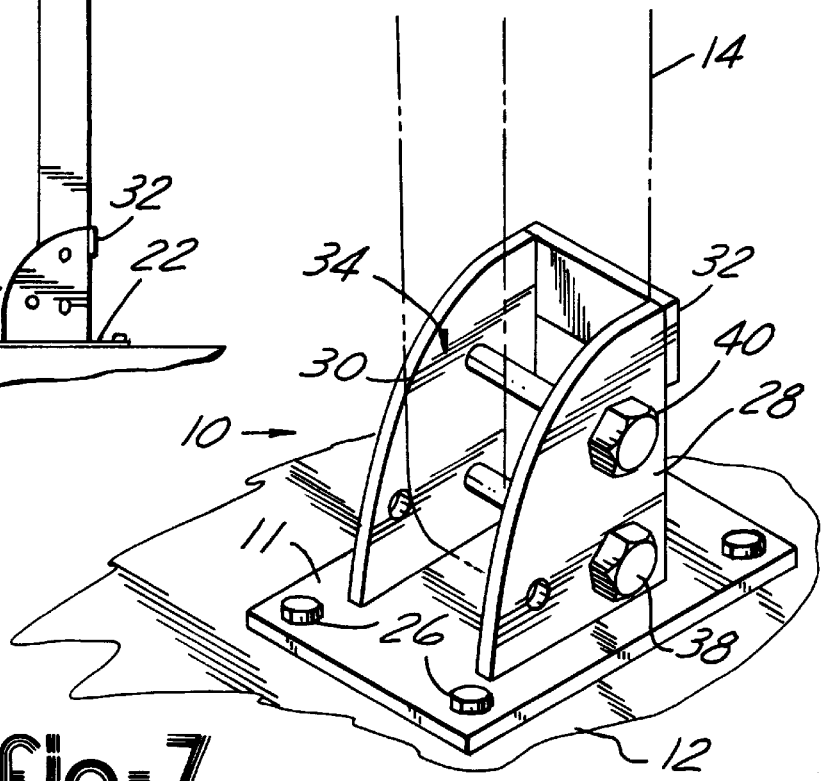
FIG. 7 is a perspective view of the preferred base of the assembly of FIG. 1 mounted in the bed of a pickup truck.

The base 10 as shown in FIG. 7 includes a generally flat bottom 11 for easy attachment to the bed 12 of the pickup truck 13 by means of bolts or clamps 26. Substantially perpendicular to the flat bottom 11, are a pair of plates 28, 30 which are positioned to form a stand for first support member 14. A support bar 32 is attached to the plates 28, 30 and lies generally parallel to and spaced above the flat bottom 11 of the base. The plates 28, 30 and bar 32 form an upright channel 34 or stand to hold the backboard assembly upright. Alternatively, a front plate (not shown) can be secured to the plates 28, 30 in place of the bar 32 to form the channel 34 in which the first support member 14 rests.

The first support member 14 is pivotably attached to the base 10 by a mounting means 38 such as a bolt or the like to the base 10 so that the lower end of the first support member 14 fits in the upright channel 34, allowing the first support member 14 to rotate between its upright and collapsed positions. In the preferred embodiment, the first support member 14 is securely attached to the base 10 by a securing means 40 which extends through openings in the plates 28, 30 and through the first support member 14. The securing means 40 in the preferred embodiment is a bolt which secures the assembly in an upright position. Alternatively, the securing means 40 can be composed of a latch pin or spring pin which can be more readily removed for transfixing the assembly from its upright position to its collapsed position. The first support member 14 can alternatively be held in place by a spring mechanism (not shown) that works to hold it erect, alternating with the above-mentioned securing means 40.

As best shown in FIG. 2, the upper end 15 of the first support member 14 is pivotably attached to the lower end 17 of the second support member 16 by a pivoting means 42. The pivoting means 42 is comprised of a bracket or hinge which allows the second support member 16 to move in relation to the first support member 14 to adjust the height H of the rim 20 and the distance D, measured from backboard 18 to the rear 19 of the pickup 13. The bracket 42 preferably is rigidly and securely attached to the upper end 15 of the first support member 14 and is pivotably attached as by bolt or pin 43 to the lower end 17 of the second support member 16.

The upper end 21 of the second support member 16 is pivotably attached to the rear of the backboard 18. In the preferred embodiment this attachment is accomplished by a bracket member 45 attached to the rear of backboard 18 and having a pair of outwardly extending plates 44 and 46. The plates 44 and 46 are pivotably attached to the upper end 21 of the second support member 16 by a bolt or screw 48 so that the backboard 18 can move in relation to the second support member 16 (as depicted by angle θ).

Figure 8:
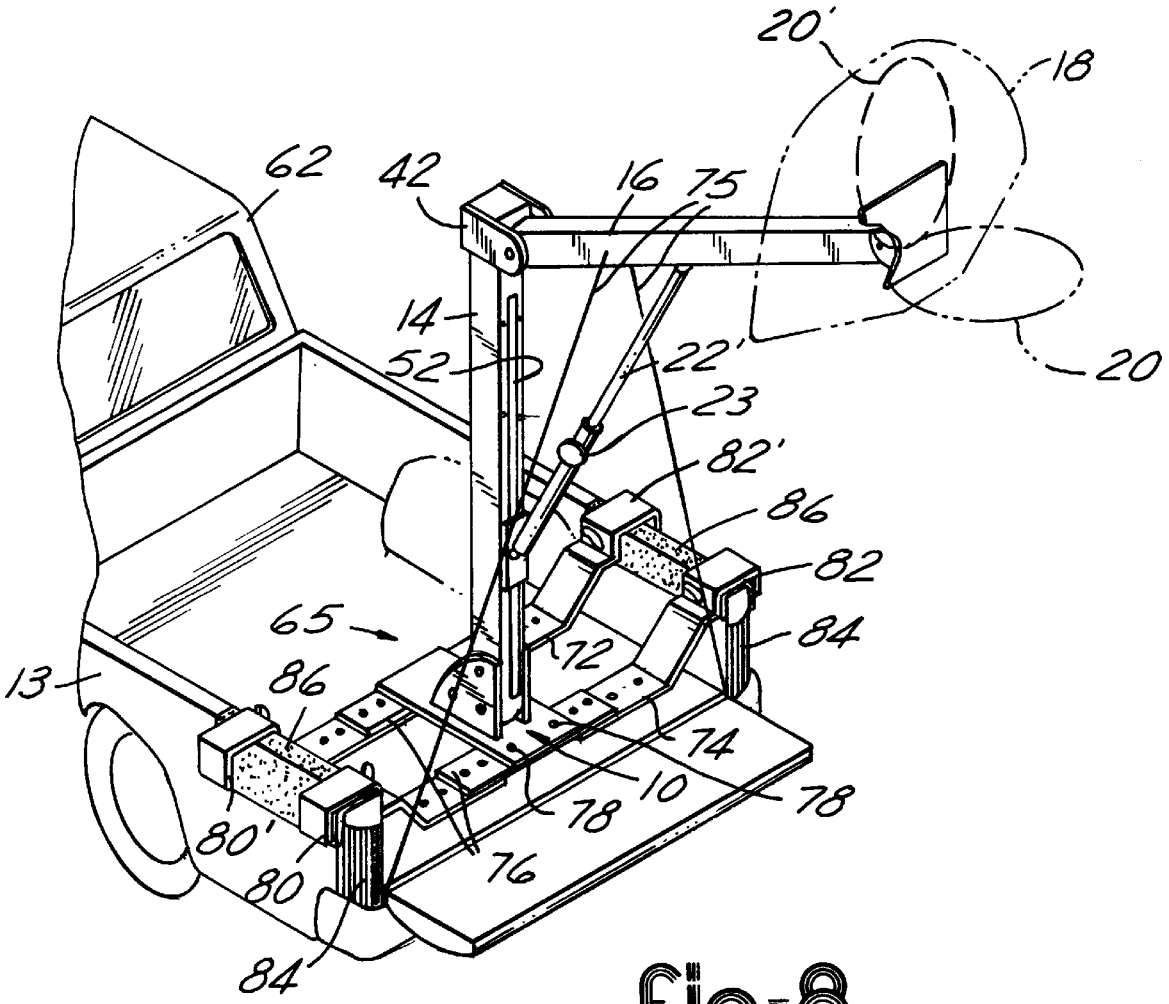
FIG. 8 illustrates an alternative system for mounting the invention on a pickup truck.

The assembly also includes a brace arm 22 which is used to support the assembly 8 in its fully upright position. The brace arm 22 is attached to the first support member 14 and to the second support member 16 at intermediary positions to provide support and stability to the assembly 8 while in use. In one embodiment, the brace arm 22 consists of a rod which is attached to support member 16 by pin 50 and which is positioned in channel 52 on the inside of the first support member 14. In the channel 52 is an adjustment means 54 which allows the brace arm 22 to be positioned at different locations. The adjustment means can consist of a series of grooves or shoulders in the channel so that the brace arm 22 can be positioned in a different groove depending upon the desired height H of the rim 20 from the ground and the desired distance D. The brace arm 22 is secured in channel 52 at the desired location by locking pin 53 or the like. The adjustability of the brace arm 22 allows the rim 20 to be adjusted to account for any variances in the playing surface 60, and keeps the backboard 18 an adequate distance D from the pickup. Furthermore, a pad 55 can be attached to the rear gate 19 of the pickup 13 to help protect the players from injury. The adjustment means 54 can also consist of a slide or rack (not shown) for adjustment of the brace arm 22. In an alternative embodiment, the brace arm 22 can be telescopic allowing the height H and distance D to be adjusted by telescoping the brace arm 22 in or out and changing the length of the brace arm as desired. (This is shown in FIG. 8 in relation to an alternate embodiment and the brace arm is designated as 22'.) The two sliding parts of the brace arm 22 can be secured with a button pin or key pin inserted in one of a plurality of holes in the arm. In this embodiment, both ends of the brace arm are pivotably secured to the support members 14 and 16 at one location.

Figure 3:
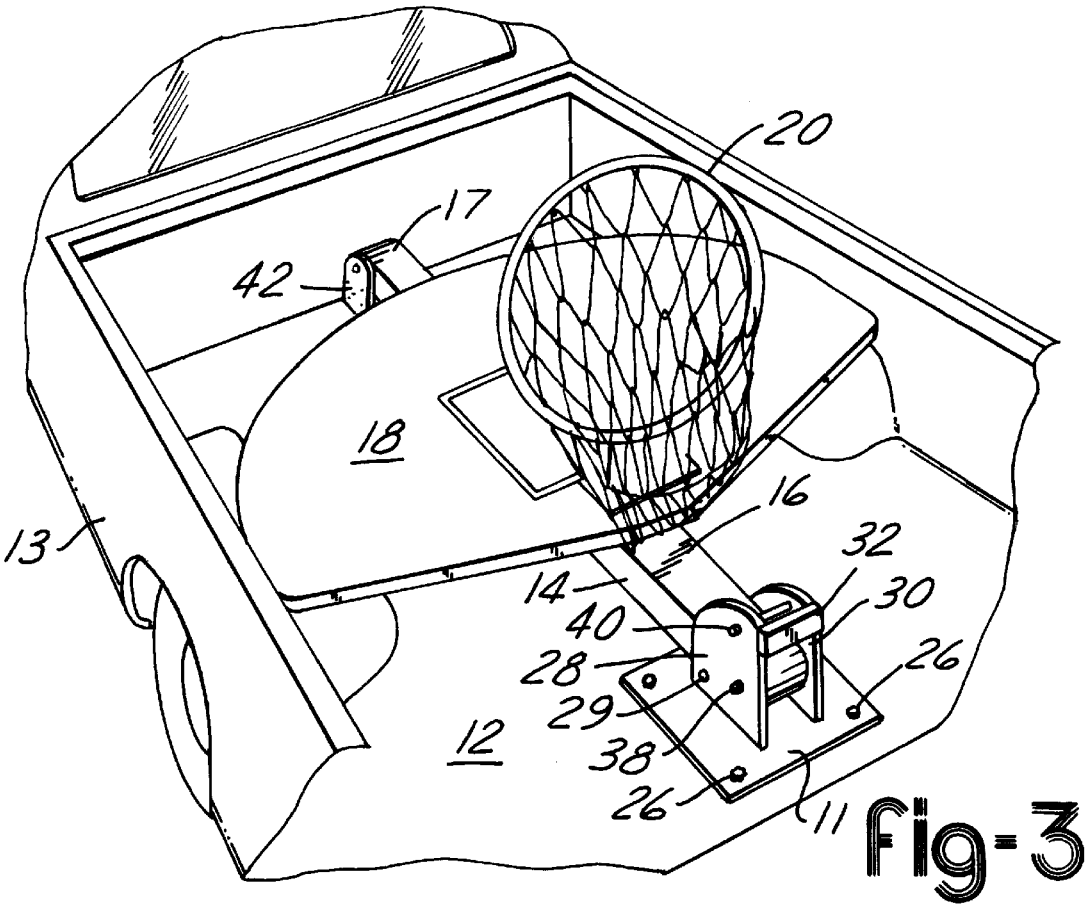
FIG. 3 is a top view of the assembly shown in FIG. 1 in fully collapsed storage in the bed of a pickup truck, and prepared for transportation.
Figure 4:
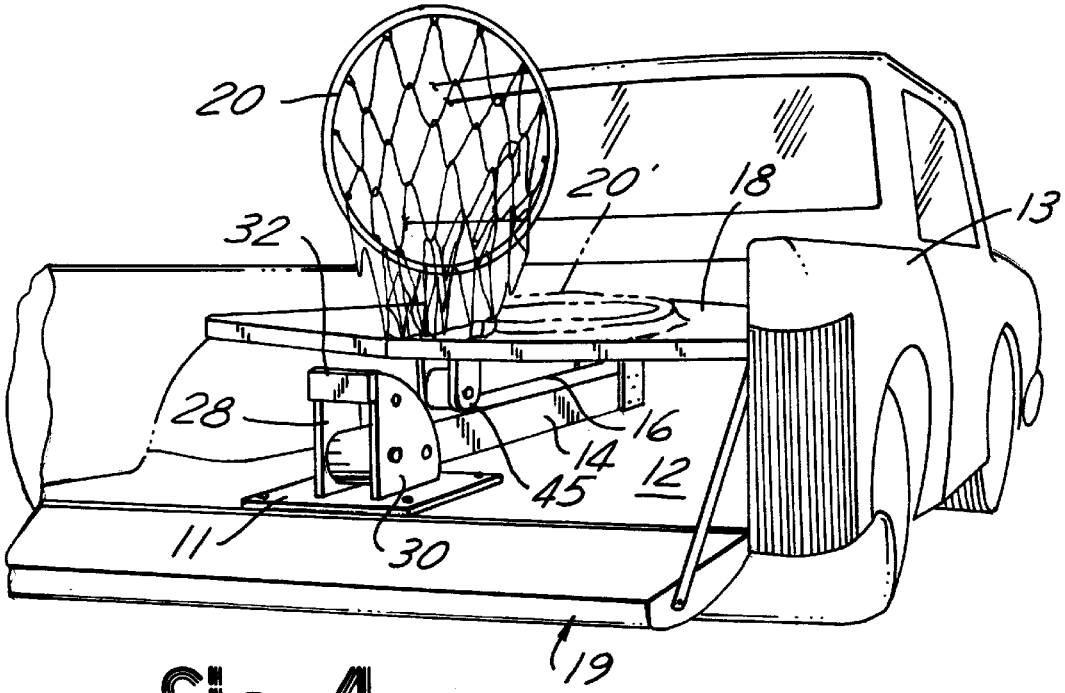
FIG. 4 is a front view of the assembly shown in FIG. 1 in a fully collapsed position.

In the presently preferred embodiment, the groove 52 is provided primarily to allow brace arm 22 to be positioned in when the assembly 8 is collapsed (as shown in FIGS. 3 and 4). The brace arm has two sections which telescopically fit within one another (22' as shown in FIG. 8) and is pivotably connected in the groove 52 by a pivot pin (not shown) at a fixed location near the lower end of support arm 14 adjacent the base member 10. The opposite end of the brace arm 22' is releasably attached to support arm 16 by a pivot pin at a fixed location. When the assembly 8 is collapsed, the brace arm 22' is released from support arm 16 and then shortened telescopically. The brace arm 22' is then rotated around its pivot point on support arm 14 and positioned longitudinally in the groove 52 for storage.

The assembly further includes a pair of backboard support arms 24 which are affixed to the top of the second support member 16 and extend to the rear of the backboard 18 where they are pivotally attached. The backboard support arms 24 are attached to the second support member 16 in a manner allowing the backboard support arms 24 to be moved to adjust the backboard to its desired location. This attachment can consist of a slide or a set of grooves in which the first end 49 of the backboard support arms 24 are positioned so they can be adjusted when in use and unattached when in its collapsed position. The support arms 24 can also be affixed to the support member 16 by a bolt or pin positioned in one of a series of holes in the support member 16. These attachment systems allow for movement of the backboard 18 to be adjusted through an angle θ to account for any variances in the playing surface 60 and keep the rim 20 at the desired angle, usually perpendicular with the playing surface 60. The backboard support arms 24 also give added support to the backboard 18 and assembly.

Although a pair of separate support members are utilized to brace the backboard relative to the second support member in the preferred embodiment, it is understood that a single support member could be utilized or a single V-shaped device with two arms. There also could be more than two support members if desired.

Additional supports can be added to insure stability of the assembly by attaching cables (not shown) or the like to the backboard 18 or second support means 16 and attaching the other end to the bed 12 of the pickup truck 13 or the playing surface 60.

The rim 20 of the assembly is securely attached to the backboard 18. The rim 20 can be rigid or can be made collapsible (foldable) so that it can also fold up when the assembly is being stored or transported. A conventional rim that is seen in a driveway or on the playground is rigidly secured to the backboard, which makes it very stiff and unforgiving. However, the conventional rims used in most gymnasiums are called "collapsible" or "break away" rims which are designed to collapse instead of bend or break when too much pressure is exerted on them. The collapsible aspect of this rim is different from the collapsibility (foldable) aspect of the present invention for storage and transporting. However, both can be utilized at the same time.

The support arms 14 and 16 are preferably made from 4"×4" wood beams, although they can be made from any conventional materials which would supply the necessary rigidity and strength. The base member 10, pivot brackets 42 and 45 and brace arms 22 and 24, are all preferably made of a metal material, such as steel. The backboard 18 and goal 20 are of conventional design and materials.

As shown in FIGS. 3 and 4, the assembly folds easily and compactly into the bed 12 of the pickup truck. The rotatable connection of the components of the assembly provide not only the ability to adjust the height H. distance D, and the angle θ, but the ability to collapse the assembly into a compact, flat package completely for storage and/or transportation. Preferably, the assembly folds within the longitudinal and lateral dimensions of the pickup bed cavity or space. This allows ease of transport and, where the rim is foldable, also allows a cover to be positioned over the bed cavity covering and protecting the folded assembly.

FIGS. 3 and 4 display the pivotal arrangement of the components of the assembly which allow the assembly to be compactly collapsed and stored in the bed 12 of the pickup truck 13. In the assembly's collapsed position, the first support member 14 is adapted so that it lies in a substantially flat position with respect to the bed 12 of the pickup truck and extends forwardly toward the front cab 62 of the pickup. The pivotal relationship between the first support member 14 and the second support member 16 allows the second support member 16 to collapse and lie on top of the first support member 14 while extending away from the cab 62 and toward the rear of the pickup. Also, the pivotal relationship between the second support member 16 and the backboard 18, allows the backboard 18 to collapse and rest on the second support member 16 so that it is substantially parallel with the bed 12 of the pickup truck. Furthermore, in one embodiment, as discussed above, the rim 20 can also be collapsed so that it lies flat against the backboard 18, further compacting and flattening the assembly 8.

In order to hold the support member 14 in the collapsed condition in the bed of the pickup truck, a locking pin 29 can be provided which passes through the side plates 28, 30 and through the lower end of the arm 14.

In the assembly's intermediary positions, as shown in FIGS. 5 and 6, the pivotal relationships between the movable members and arms are again shown. In FIG. 5 the first support member 14 and the second support member 16 are still in contact with each other but the first support member 14 is fully rotated with respect to the base 10 to its vertical position where it is locked in position. The arrow 80 indicates the direction in which the members are rotated. The rim 20 is extended, and the backboard 18, which is still in its collapsed position, is subsequently adjusted when the second support member 16 is raised and held in place by the bracing arm 22.

From the position shown in FIG. 5, the second support member 16 is then raised to its appropriate position (as shown by arrow 81 in FIG. 6). This can be done by attaching the brace arm 22 to the support member 16 at its intermediary point 50 and using the brace arm as a lever to position the member 16 at the requisite position. In accordance with one embodiment of the invention, the lower end of the brace arm 22 is then positioned in place in the appropriate groove or by the adjustment means 54 in the channel 52. In accordance with another embodiment in which the lower end of brace arm 22' is fixedly attached to support arm 14, the two telescoping portions of the brace arm are pinned or otherwise locked in place with a pin 23 once the support arm 16 is in its proper position. The second support member 16 can also be manually raised to its desired position, with the brace arm 22 then being inserted in place.

Once at its desired height, the backboard 18 is rotated and positioned in place—usually perpendicular to the ground or playing surface 60. If the rim 20 is not at the desired height H, then the brace arm 22 and second support member 16 are adjusted until the desired height H is obtained. The angle θ of the backboard can then be adjusted accordingly or to account for any inconsistencies in the playing surface 60. This is accomplished by releasing and repositioning the backboard support arms 24 on the second support member 16 so that the backboard 18 moves through an angle θ with respect to the vertical axis.

These intermediary positions are consistent with both the disassembly and storing of the assembly, as well as the setting up of the assembly for use. For disassembly and storage of the assembly 8, the assembly sequence and procedure described above is reversed.

The invention provides a portable basket for playing basketball which can be easily moved to different locations and set up without tools and with a minimum of time and effort. Also, the device preferably is not permanently secured in the bed of the pickup truck and can be removed when desired and stored so that the truck can be used for its standard purposes.

In accordance with another method for assembling and deploying the invention from its collapsed or stored position, the support arm 16 is first raised manually until the backboard 18 can be rotated and fixed in its approximate position for use. The brace arm 22' is then attached to the support arm 16 (at 50) and the two telescopic portions are adjusted and pinned together to lengthen the brace arm. The assembly 8 is rotated upwardly from the bed of the pick-up until the support arm 14 is positioned vertically in the base member 10 and pinned in place. Thereafter, the positions of the support arm 16 and backboard 18 are readjusted until the backboard and goal are set in their desired positions.

The base 10 of the assembly can be secured to the pickup truck 13 in various other ways in accordance with the present invention. FIG. 8 shows an alternative structure for accomplishing this. In this embodiment, a support 65 is positioned transversely across the bed of the pickup truck and supported by the side rails 84. The support 65 has a pair of transverse members 72 and 74 which have central portions 76 positioned parallel to the bed 12 of the pickup truck. Preferably the central portions 76 rest on the bed 12 of the truck for stability. The base 10 is attached to the central portions 76 by a plurality of bolts or other conventional fasteners 78. The transverse members each have a pair of attachment members 80, 82 and 80', 82' which extend over the side rails 84 of the pickup truck and are attached to the rails or to the outside of the truck in any conventional manner. Pads 86 are positioned under the attachment members to protect the finish of the truck. This embodiment is easily removable from the pickup 13 and does not damage the integrity of the floor of the bed 12.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

We claim:

1. A portable collapsible backboard and basket assembly mounted in the bed of a pickup truck, the bed having a floor and a plurality of raised sidewalls forming a cavity, the assembly comprising:

base means positioned in and securely affixed to the pickup truck within the cavity of the pickup truck;

foldable support means attached to said base means and rotatable between a storage position adjacent the floor of the bed of the pickup truck and to a display position substantially perpendicular to the floor of the bed of the pickup truck;

a backboard foldably and rotatably attached to said support means; and a basketball basket attached to said backboard; and wherein when said assembly is folded and collapsed into said storage position, it forms a compact package sized to fit within said cavity of the pickup truck, and wherein when said assembly is erected into said display position, it holds and supports said backboard in position above and outside the dimensions of the cavity.

2. The portable basketball backboard and basket assembly of claim 1 wherein said assembly is collapsed into said storage position, the backboard lies substantially parallel to the floor of the bed.

3. The portable basketball backboard and basket assembly of claim 1 wherein said base means includes a channel for supporting said support means in said substantially perpendicular position.

4. The portable basketball backboard and basket assembly of claim 1 further comprising brace means for holding said support means in said display position.

5. The portable basketball backboard and basket assembly of claim 4 wherein said brace means is adjustable and said backboard and basket can be positioned at various vertical positions.

6. The portable basketball backboard and basket assembly of claim 1 wherein said basket is foldable for storage to a position substantially parallel to said backboard.

7. The portable basketball backboard and basket assembly of claim 1 further comprising cable means extending between said support means and said pickup truck.

8. The portable basketball backboard and basket assembly of claim 1 wherein said support means includes a first support member attached to said base means and a second support member attached to said first support member.

9. The portable basketball backboard and basket assembly of claim 8 wherein the first support member is rotatably connected to said base means, said second support member is rotatably connected to said first support member, said backboard is rotatably connected to said second support member and said basket is rotatably connected to said backboard.

10. The portable basketball backboard and basket assembly of claim 1 further comprising a first brace member for supporting said support means relative to said base means, and a second brace member for supporting said backboard relative to said support means, said second brace member being adjustable for positioning said backboard at different vertical angles in order to compensate for non-level playing surfaces.

* * * * *